US006001790A

United States Patent [19]

Schmitt et al.

[11] Patent Number: 6,001,790

[45] Date of Patent: Dec. 14, 1999

[54] MIXTURES OF ALKOXYLATES HAVING FOAM-SUPPRESSING AND DISINFECTING ACTION AND THEIR USE IN CLEANING PRODUCTS

[75] Inventors: Norbert Schmitt, Burgkirchen; Manuela Hingerl, Tüssling, both of Germany

[73] Assignee: Clariant GmbH, Frankfurt, Germany

[21] Appl. No.: 08/992,156

[22] Filed: Dec. 17, 1997

[30] Foreign Application Priority Data

Dec. 18, 1996 [DE] Germany ..... 196 52 680

[51] Int. Cl.[6] ..... C11D 1/722; C11D 3/37; C11D 1/825

[52] U.S. Cl. ..... 510/219; 510/421; 510/423; 510/433; 510/475; 510/499; 510/413

[58] Field of Search ..... 510/220, 221, 510/263, 219, 383, 421, 433, 423, 475, 499, 413

[56] References Cited

U.S. PATENT DOCUMENTS

| | | | |
|---|---|---|---|
| 5,223,162 | 6/1993 | Rossio | 252/33.2 |
| 5,393,789 | 2/1995 | Eggensperger et al. | 514/674 |
| 5,415,837 | 5/1995 | Schafer et al. | 422/28 |
| 5,516,451 | 5/1996 | Schmitt et al. | 252/174.21 |
| 5,576,284 | 11/1996 | Van Buskirk et al. | 510/384 |
| 5,776,352 | 6/1998 | Vanlaer | 210/749 |

FOREIGN PATENT DOCUMENTS

| | | |
|---|---|---|
| 322781 | 1/1995 | European Pat. Off. . |
| 0694606 | 4/1996 | European Pat. Off. . |
| 694606 | 5/1996 | European Pat. Off. . |
| 2701037 | 8/1994 | France . |
| 1488108 | 10/1977 | United Kingdom . |
| WO 96/10069 | 4/1996 | WIPO . |
| WO 96100069 | 4/1996 | WIPO . |

OTHER PUBLICATIONS

European Search Report.
Derwent Patent Family Report and/or Abstracts.

*Primary Examiner*—Yogendra Gupta
*Assistant Examiner*—Gregory E. Webb
*Attorney, Agent, or Firm*—Miles B. Dearth

[57] ABSTRACT

The mixtures according to the invention consist essentially of fatty alcohol ethoxylate propoxylates, fatty alcohol ethoxylate mixed formals and/or end-capped fatty alcohol alkoxylates as the first main component and certain fatty alkyl polyamines as the other main component. They are particularly notable for a high foam-suppressing and disinfecting ability and are particularly suitable for aqueous cleaning liquors for the mechanical cleaning of hard surfaces.

9 Claims, No Drawings

MIXTURES OF ALKOXYLATES HAVING FOAM-SUPPRESSING AND DISINFECTING ACTION AND THEIR USE IN CLEANING PRODUCTS

This application claims priority from Federal Republic of Germany Application 19652680.9 filed Dec. 18, 1996.

The invention relates to mixtures of alkoxylates having foam-suppressing and disinfecting action and their use in aqueous cleaning liquors for hard surfaces.

Hard surfaces (such as bottles made from plastic or glass, crockery made from porcelain, ceramic, glass or plastic or other objects made of such materials or made of metal) are generally cleaned in commercial and industrial cleaning equipment using an aqueous solution of alkali metal hydroxides, preferably sodium hydroxide solution (alkaline cleaning liquor) or using aqueous acid solutions (acidic cleaning liquor). Here cleaning involves a high throughput and high liquor agitation and spray intensities in order to ensure rapid detachment and emulsification of adhering soil. Because of the high mechanical liquor agitation, the system should be very low-foam or foam-free, since excessive foaming can lead to equipment problems. Foaming is additionally encouraged by the soil which is dislodged into the liquor off the ware, particularly by proteinaceous residues on the ware. In the case of bottle cleaning, this also particularly applies to the labels to be removed, which introduce glue residues and residues of printing inks, including surfactant auxiliaries contained in the latter, into the cleaning liquor.

It has been known for some time to use nonionic surfactants as foam suppressants in alkaline or acidic aqueous base solutions for cleaning hard surfaces. These surfactants include in particular the addition products of ethylene oxide and/or propylene oxide with amines, fatty alcohols or alkylphenols, polyglycol ether formals or polyglycol ether acetals or block copolymers of ethylene oxide and propylene oxide.

Another important requirement for auxiliaries in alkaline or acidic aqueous cleaning liquors is the disinfecting action. It is of course desirable to operate the cleaning equipment at as low a temperature as possible since this not only leads to a considerable saving in terms of energy, but also results in a more gentle treatment of the ware. However, low temperatures presuppose that cleaning liquors (in addition to the aforementioned properties, detergency, wetting ability and low foam) also have a high antimicrobial action.

DE-A-25 23 588 (GB-A-1 488 108) describes polyglycol ether mixed formals, EP-B-322 781 describes end-capped fatty alcohol alkoxylates and EP-A-694 606 describes mixtures of a fatty alcohol ethoxylate propoxylate and a fatty amine or fatty amine ethoxylate as foam-suppressing additives for cleaning products. Mention may also be made of WO-A-96/10069, which describes disinfectant cleaners for hard surfaces. In particular, it discusses the use of a mixture of an alkyl and/or alkenyl oligoglycoside and a fatty alcohol alkoxylate for enhancing the antimicrobial action of cleaning products containing disinfectants for hard surfaces. Cited disinfectants, whose action is said to be increased by adding the said mixture, are, inter alia, also fatty alkyl polyamines, such as N,N-bis(3-aminopropyl)dodecylamine.

It has now been found that a combination of selected alkoxylates and fatty alkyl polyamines produces an unexpectedly high synergistic effect with respect to foam suppression and germ killing as well as detergency and wetting ability. This result is all the more surprising since, as is known, fatty alkyl polyamines are good foaming agents.

The mixtures according to the invention consist essentially of

A) from 30 to 70% by weight, preferably from 40 to 60% by weight, of at least one alkoxylate from the group consisting of A1) fatty alcohol ethoxylate propoxylates of the formula I $$RO—(C_2H_4O)_x—(C_3H_6O)_y—H \quad (I)$$

where R is an alkyl radical or alkenyl radical having from 6 to 22 carbon atoms, preferably from 8 to 18 carbon atoms, x is a number from 1 to 10, preferably from 2 to 7, and y is a number from 1 to 10, preferably from 2 to 7, A2) fatty alcohol ethoxylate mixed formals of the formula II $$R^1O—(C_2H_4O)_z—CH_2—OR^2 \quad (II)$$

where $R^1$ is an alkyl radical or alkenyl radical having from 6 to 22 carbon atoms, preferably from 8 to 18 carbon atoms, z is a number from 1 to 10, preferably from 2 to 7, and $R^2$ is an alkyl radical having from 1 to 4 carbon atoms, and A3) end-capped fatty alcohol alkoxylates of the formula III $$R^3O—(C_2H_4O)_a—(C_3H_6O)_b—R^4 \quad (III)$$

where $R^3$ is an alkyl radical or alkenyl radical having from 6 to 22 carbon atoms, preferably from 8 to 18 carbon atoms, a is a number from 2 to 20, preferably from 4 to 15, b is a number from 0 to 10, preferably from 0 to 5, and $R^4$ is an alkyl radical having from 1 to 5 carbon atoms, and B) from 30 to 70% by weight, preferably from 40 to 60% by weight, of at least one fatty alkyl polyamine of the formula IV $$R^5—\underset{\underset{R^6}{|}}{N}—(CH_2)_n—NH_2 \quad (IV)$$

where $R^5$ is an alkyl radical or alkenyl radical having from 6 to 22 carbon atoms, preferably from 8 to 18 carbon atoms, n is an integer from 2 to 6, preferably 3, and $R^6$ is H, an alkyl radical or alkenyl radical having from 6 to 22 carbon atoms, preferably from 8 to 18 carbon atoms, or a $—(CH_2)_m—NH_2$ radical, in which m is an integer from 2 to 6, preferably 3.

Preferred mixtures according to the invention consist essentially of

A1) from 10 to 60% by weight, preferably from 20 to 40% by weight, of at least one fatty alcohol ethoxylate propoxylate of the formula I, A2) from 10 to 60% by weight, preferably from 20 to 40% by weight, of at least one fatty alcohol ethoxylate mixed formal of the formula II and/or A3) from 0 to 60% by weight, preferably from 0 to 40% by weight, of at least one end-capped fatty alcohol alkoxylate of the formula III, with the proviso that the total amount of components A2 and A3 is from 10 to 60% by weight, preferably from 20 to 40% by weight, and B1) from 30 to 70% by weight, preferably from 40 to 60% by weight, of at least one fatty alkyl polyamine of the formula IV.

The components to be used according to the invention may be further described as follows: The alkyl and alkenyl radicals may be linear or branched, linear being preferred. The alkenyl radicals preferably have from 1 to 3 double bonds. The numbers given for x, y, z, a and b are statistical means (average values), i.e. these indices may in each case be an integer or a fraction. The propylene oxide units can be of the type —$CH_2$—$CH(CH_3)O$— or —$CH(CH_3)$—$CH_2O$—, the former being preferred. Examples of alkyl and alkenyl radicals are n-hexyl, n-heptyl, n-octyl, 2-ethylhexyl, iso-nonyl, n-decyl, iso-decyl, n-dodecyl, stearyl, n-eicosyl, oleyl, coconut alkyl and tallow alkyl and also alkyl or alkenyl mixtures, for example a mixture of $C_{12}$-alkyl to $C_{14}$-alkyl ($C_{12/14}$). The components A1, A2 and A3 in the described preferred mixture can in each case be used alone or combined, it being possible for the mixing ratio to be varied within wide limits.

Component B is preferably any amine compound which conforms to formula IV where $R^5$ is an alkyl radical or alkenyl radical having from 6 to 22 carbon atoms, preferably from 8 to 18 carbon atoms, and $R^6$ is the said radical —$(CH_2)_m$—$NH_2$, where m is equal to n, i.e. m and n are in each case an integer from 2 to 6, preferably 3. Particularly preferred amines according to formula IV are thus fatty alkyl dipropylenetriamines. All components to be used according to the invention are known from the publications cited at the beginning and are available commercially.

The products according to the invention are prepared simply by mixing together the components and optionally other advantageous additives at a temperature of from 15 to 50° C., preferably from 20 to 30° C., and advantageously with stirring.

The mixtures according to the invention can be used in undiluted form, i.e. neat, or, for example, to achieve better meterability, in the form of aqueous concentrates, optionally with the addition of an organic solvent. The described components can of course also be added to the aqueous cleaning liquor separately. The use concentration in the aqueous liquors (alkaline or acidic) is advantageously from 0.05 to 10 g of the mixture according to the invention per liter of cleaning liquor, preferably from 0.1 to 2 g per liter. The said use concentrations are noncritical values since the quantity is determined to a certain extent by the type of surfaces to be cleaned and by the nature and extent of the soiling.

As mentioned above, further additives and auxiliaries may be added to the surfactant mixtures according to the invention to prepare standard commercial formulations. Examples of these are dyes, perfumes, corrosion inhibitors and disinfectants. Also to be cited here are the known builders which are also complexing agents in some instances. These include the condensed phosphates such as tripolyphosphates and pentasodium triphosphate, the complexing amino polycarboxylic acids and their salts, for example the alkali metal salts of nitrilotriacetic acid and of ethylene-diaminetetraacetic acid, and the complexing hydroxycarboxylic acids and polymeric carboxylic acids such as citric acid, tartaric acid and the like. Another class of complexing builders are polyphosphonic acid salts, such as, for example, the alkali metal salts of aminophosphonic acid. Finally, it is also possible to add builders such as silicates, for example sodium metasilicate, carbonates, bicarbonates, borates and citrates. Such additives allow the surfactant mixtures according to the invention to be converted into powder form, if desired, and be used in this form.

The mixtures according to the invention are notable for a high disinfecting and foam-suppressing action. They are extremely low foam and foam-forming at low and elevated temperatures (for example in the range from 15 to 80° C.) and even during vigorous liquor movement and in the presence of foam-promoting soils, such as protein, milk, beer, lemonade, glue or other adhesives and the like. The likewise unexpectedly high antimicrobial property extends to all common microorganisms. The mixtures according to the invention also have a high cleaning action and a high dirt-holding capacity, which permits long operating times without impairment of the cleaning action. Their good wetting ability and run-off behavior permit rapid soil detachment and thus a high throughput of ware. The cleaned ware is free from spots and streaks and shows high sparkle (i.e. no attack on the appearance) and no damage whatsoever (i.e. no impairment, for example, of the mechanical stability). The mixtures according to the invention are also resistant to alkali and acids and are stable in storage in their presence.

The surfactant mixtures according to the invention are very generally suitable for cleaning liquors. They are particularly suitable for alkaline liquors for the mechanical cleaning of hard surfaces, such as, for example, for liquors in household dishwashers and in commercial cleaning equipment. In the case of industrial cleaning equipment for hard surfaces, they are especially suitable for crockery and bottle washers which operate continuously with aqueous alkaline liquors with high mechanical liquor agitation where the pH can be $\geqq 10$ or $\geqq 12$ (highly alkaline liquors). Another example which may be cited is the cleaning of bottles made of glass or polyethylene terephthalate (PET) in breweries and in bottling plants for nonalcoholic beverages. As will be known, alkaline cleaning liquors consist essentially of from 95 to 99% by weight of water and from 1 to 5% by weight of a sodium hydroxide and/or potassium hydroxide. The product according to the invention is also suitable for aqueous acidic cleaning liquors which, as will be known, consist essentially of from 50 to 80% by weight of water and from 20 to 50% by weight of, preferably, phosphoric acid or sulfuric acid.

The invention is illustrated by examples (EO=ethylene oxide and PO=propylene oxide).

EXAMPLES 1 to 8

The following compounds are used in the examples:

Component A1:

A1/1 $C_{10/12}$-fatty alcohol+4 EO+4 PO

A1/2: $C_{12/14}$-fatty alcohol+5 EO+4 PO

A1/3: $C_{12/14}$-fatty alcohol+4 EO+5 PO

Component A2:

A2/1: $C_{8/18}$-fatty alcohol+2.5 EO-methyl mixed formal (i.e. $R^2$ in formula II is —$CH_3$)

A2/2: $C_{8/18}$-fatty alcohol+5 EO-methyl mixed formal (i.e. $R^2$ in formula II is —$CH_3$)

Component A3:

A3/2: $C_{12/16}$-fatty alcohol+9 EO-butyl-end-capped (i.e. $R^4$ in formula III is —$C_4H_9$)

Component B:

B1: $C_{8/10}$-fatty alcohol dipropylenetriamine (N,N-bis(3-aminopropyl)-$C_{8/10}$-fatty alkylamine)

B2: N,N-bis(3-aminopropyl)dodecylamine

The compositions according to the invention are tested in respect of foaming behavior, disinfecting action and PET bottle stability. The test methods are given below:

Foam test

The foaming behavior test is carried out in accordance with German standard specification DIN 53902 at 65° C. 1.5 g of the formulation according to the invention are dissolved in 1 l of 1% sodium hydroxide solution, prepared from 10 g of NaOH microprills in 1 l of completely demineralized water. 200 ml of this solution are introduced into a 1000-ml measuring cylinder and beaten 30 times by means of a perforated impact disc. The resulting foam height in the measuring cylinder, expressed in milliliters, represents the foam value of the mixture.

Disinfection

The test solution used is a microorganism suspension comprising mold (Alternaria sp., Penicillium sp. and others) and yeasts (Monilia nigra, Rhadotarula rubra and others), having $>10^6$ CFU/g. For the test series, an LT-CASO AGAR (CASO-nutrient medium with lecithin and Tween) is used. The screening test for testing the disinfecting action involves spreading 0.1 ml of the microorganism suspension on the nutrient medium and adding in each case 0.5 ml of the formulations according to the invention. For the second test series, 20 g of NaOH microprills are dissolved in 1 l of completely demineralized water. 50 g of this solution are in each case treated with 0.1 g, 0.25 g and 0.5 g of each of the formulations according to the invention. 0.25 ml of the microorganism suspension is added to each of the mixtures. After 0 minutes, 5 minutes and 10 minutes, a 0.1 ml sample is taken in each case and placed on the nutrient medium. The thus-treated nutrient media are incubated at room temperature for 5 days and microorganism growth on the nutrient medium is assessed.

Stability of PET bottles

The bottle stability test is carried out in a thermostated 4 l glass vessel. 120 g of NaOH microprills are dissolved in 4 l of completely demineralized water and 6 g of the formulation according to the invention are added. This solution is held at 60° C. Into this bath, which is recirculated by means of a peristaltic pump, the PET bottles are dipped for 15 minutes, and they are then thoroughly rinsed with fresh water and flushed with compressed air at 5 bar for 10 minutes. This cycle is repeated 25 times. The PET bottles are then assessed as regards their optical appearance and cracking in the bottom region (stress corrosion cracking).

Table 1 below summarises Examples 1 to 8 (the stated amounts of components are given as percentages by weight) and the test results (++ means good, + means moderate and −− means poor):

TABLE 1

| | Examples | | | | | | | |
|---|---|---|---|---|---|---|---|---|
| Components | 1 | 2 | 3 | 4 | 5 | 6 | 7 | 8 |
| A1/1 | | | | | 30 | 20 | 22 | |
| A1/2 | 22 | | | | | | | 22 |
| A1/3 | | 29 | | 30 | | | | |
| A2/1 | | | | 15 | | 20 | | |
| A2/2 | 29 | 22 | 22 | 15 | 15 | | 23 | 29 |
| A3/11 | | | 29 | | 15 | 15 | | |
| B1 | | | | | | 45 | | 49 |
| B2 | 49 | 49 | 49 | 40 | 40 | | 55 | |
| Foam values | + | + | + | ++ | ++ | ++ | + | + |
| Disinfection | ++ | ++ | + | ++ | ++ | ++ | ++ | + |
| Bottle stability | ++ | ++ | ++ | + | ++ | ++ | ++ | ++ |

What is claimed is:

1. A mixture of alkoxylates having foam-suppressing and disinfecting action consisting of A) from 30 to 70% by weight, of at least one alkoxylate from the group consisting of A1) fatty alcohol ethoxylate propoxylates of the formula I $$RO—(C_2H_4O)_x—(C_3H_6O)_y—H \quad (I)$$

where R is an alkyl radical or alkenyl radical having from 6 to 22 carbon atoms, x is a number from 1 to 10, and y is a number from 1 to 10, A2) fatty alcohol ethoxylate mixed formals of the formula II $$R^1O—(C_2H_4O)_z—CH_2—OR^2 \quad (II)$$

where $R^1$ is an alkyl radical or alkenyl radical having from 6 to 22 carbon atoms, z is a number from 1 to 10, and $R^2$ is an alkyl radical having from 1 to 4 carbon atoms, and A3) end-capped fatty alcohol alkoxylate of the formula III $$R^3O—(C_2H_4O)_a—(C_3H_6O)—OR^4 \quad (III)$$

where $R^3$ is an alkyl radical or alkenyl radical having from 6 to 22 carbon atoms, a is a number from 2 to 20, b is a number from 0 to 10, and $R^4$ is an alkyl radical having from 1 to 5 carbon atoms, and B) from 30 to 70% by weight, of at least one fatty alkyl polyamine of the formula IV $$R^5—\underset{\underset{R^6}{|}}{N}—(CH_2)n—NH_2 \quad (IV)$$

where $R^5$ an alkyl radical or alkenyl radical having from 6 to 22 carbon atoms, n is an integer from 2 to 6, and $R^5$ is H, an alkyl radical or alkenyl radical having from 6 to 22 carbon atoms, or a $—(CH_2)_m—NH_2$ radical, in which m is an integer from 2 to 6 optional additives and auxiliaries.

2. The mixture as claimed in claim 1 wherein

A1) is from 10 to 60% by weight, of at least one fatty alcohol ethoxylate propoxylate of the formula I, A2) is from 10 to 60% by weight, of at least one fatty alcohol ethoxylate mixed formal of the formula II and/or A3) is from 0 to 60% by weight, of at least one end-capped fatty alcohol alkoxylate of the formula III, with the proviso that the total amount of components A2 and A3 is from 10 to 60% by weight, and B) is from 30 to 70% by weight, of at least one fatty alkyl polyamine of the formula IV.

3. The mixture as claimed in claim 1 wherein

A) is from 40 to 60% by weight and

B) is from 40 to 60% by weight.

4. The mixture as claimed in claim 2 wherein

A1) is from 20 to 40% by weight,

A2) is from 20 to 40% by weight and/or

A3) is from 0 to 40% by weight, with the proviso that the total amount of components A2 and A3 is from 20 to 40% by weight, and B) is from 40 to 60% by weight.

5. A mixture as claimed in claim 1, wherein, in formula I, R is an alkyl radical or alkenyl radical having from 8 to 18 carbon atoms, x is a number from 2 to 7 and y is a number from 2 to 7, in formula II, $R^1$ is an alkyl radical or alkenyl radical having from 8 to 18 carbon atoms and z is a number from 2 to 7, in formula III, $R^3$ is an alkyl radical or alkenyl radical having from 8 to 18 carbon atoms, a is a number from 4 to 15 and b is a number from 0 to 5, and in formula IV, $R^5$ is an alkyl radical or alkenyl radical having from 8 to 18 carbon atoms, n is 3 and $R^6$ is a $—(CH_2)_m—NH_2$ radical, in which m is 3.

6. The method of using the mixture as claimed in claim 1 in aqueous cleaning liquors for the mechanical cleaning of hard surfaces.

7. The method of using the mixture as claimed in claim 1 in aqueous cleaning liquors for the mechanical cleaning of bottles made of glass or polyester.

8. A mixture of alkoxylates having foam-suppressing and disinfecting action comprising (A) from 30 to 70% by weight, (i) fatty alcohol ethoxylate propoxylates of the formula I $$RO—(C_2H_4O)_x—(C_3H_6O)_y—H \quad (I)$$

where R is an alkyl radical or alkenyl radical having from 6 to 22 carbon atoms, x is a number from 1 to 10, and y is a number from 1 to 10, (ii) fatty alcohol ethoxylate mixed formals of the formula II $$R^1O—(C_2H_4O)_z—CH_2—OR^2 \quad (II)$$

where $R^1$ is an alkyl radical or alkenyl radical having from 6 to 22 carbon atoms, z is a number from 1 to 10, and $R^2$ is an alkyl radical having from 1 to 4 carbon atoms, and (B) from 30 to 70% by weight, of at least one fatty alkyl polyamine of the formula IV $$R^5—\underset{\underset{R^6}{|}}{N}—(CH_2)_n—NH_2 \quad (IV)$$

where $R^5$ an alkyl radical or alkenyl radical having from 6 to 22 carbon atoms, n is an integer from 2 to 6, and $R^6$ is H, an alkyl radical or alkenyl radical having from 6 to 22 carbon atoms, or a $—(CH_2)_m—NH_2$ radical, in which m is an integer from 2 to 6.

9. A mixture of alkoxylates having foam-suppressing and disinfecting action comprising (A) from 30 to 70% by weight, of (ii) fatty alcohol ethoxylate mixed formals of the formula II $$R^1O—(C_2H_4O)_z—CH_2—OR^2 \quad (II)$$

where $R^1$ is an alkyl radical or alkenyl radical having from 6 to 22 carbon atoms, z is a number from 1 to 10, and $R^2$ is an alkyl radical having from 1 to 4 carbon atoms, and (iii) end-capped fatty alcohol alkoxylate of the formula III $$R^3—(C_2H_4O)_a—(C_3H_6O)—OR^4 \quad (III)$$

where $R^3$ is an alkyl radical or alkenyl radical having from 6 to 22 carbon atoms, a is a number from 2 to 20, b is a number from 0 to 10, and $R^4$ is an alkyl radical having from 1 to 5 carbon atoms, and (B) from 30 to 70% by weight, of at least one fatty alkyl polyamine of the formula IV $$R^5—\underset{\underset{R^6}{|}}{N}—(CH_2)_n—NH_2 \quad (IV)$$

where $R^5$ an alkyl radical or alkenyl radical having from 6 to 22 carbon atoms, n is an integer from 2 to 6, and $R^6$ is H, an alkyl radical or alkenyl radical having from 6 to 22 carbon atoms, or a $—(CH_2)_m—NH_2$ radical, in which m is an integer from 2 to 6.

* * * * *